US006161358A

United States Patent [19]

Mochizuki et al.

[11] Patent Number: 6,161,358

[45] Date of Patent: Dec. 19, 2000

[54] MODULAR MOBILE DRILLING SYSTEM AND METHOD OF USE

[76] Inventors: David A. Mochizuki, 1 Anchor Point Pl., The Woodlands, Tex. 77381; Siegfried Meissner, 15914 Stratton Park Dr., Spring, Tex. 77379; Stevan D. Stronach, 49 Thorngrove Crescent, Aberdeen, Scotland, United Kingdom AB157FH, United Kingdom

[21] Appl. No.: 09/360,964

[22] Filed: Jul. 27, 1999

Related U.S. Application Data

[60] Provisional application No. 60/094,389, Jul. 28, 1998.

[51] Int. Cl.[7] ..... E04H 12/00

[52] U.S. Cl. ..... 52/651.05; 405/201; 405/303

[58] Field of Search ..... 52/651.05, 651.1, 52/651.01, 650.3, 650.1, 561, 122.1, 125.1, 127.1, 562; 405/303, 232; 212/294, 175

[56] References Cited

U.S. PATENT DOCUMENTS

| | | | |
|---|---|---|---|
| 4,394,104 | 7/1983 | Camerini | 414/276 |
| 4,563,109 | 1/1986 | Ortemond | 405/195 |
| 4,676,762 | 6/1987 | Ballard | 446/104 |
| 5,492,436 | 2/1996 | Suksumake | 405/201 |
| 5,997,217 | 12/1999 | Verret | 405/196 |
| 6,045,297 | 4/2000 | Voorhees | 405/303 |

*Primary Examiner*—Carl D. Friedman
*Assistant Examiner*—Kevin McDermott
*Attorney, Agent, or Firm*—Baker Botts L.L.P.

[57] ABSTRACT

A modular mobile drilling system and method of use supports land-based drilling operations on remote sites. Plural support boxes fixedly deployed in first and second rows define a drilling zone. A plurality of platform support beams disposed from the first row to the second row support a platform for holding drilling equipment. An actuator associated with the platform and beams skids the support beams relative to the boxes to align the platform with predetermined positions in the drilling zone, allowing the drilling of multiple wells along the length of the support box rows. The drilling equipment can also skid laterally across the drilling platform to support drilling of multiple rows of wells in the drilling zone. The drilling platform is supported by some but not all of the support boxes, enabling modular transportation by helicopter of support boxes to a new remote drilling site, disassembly of the drilling platform at the existing site, reassembly of the drilling platform on the transported boxes at the new site, and then transportation of remaining boxes from the existing site to the new site to support new drilling operations. The box-on-box substructure and skiddable drilling platform enhance transportability by helicopter and assembly with minimal footprint and reduced assembly steps.

10 Claims, 6 Drawing Sheets

MODULAR MOBILE DRILLING SYSTEM AND METHOD OF USE

This application claims the benefit of U.S. Provisional Application No. 60/094,389, filed Jul. 28, 1998.

TECHNICAL FIELD OF THE INVENTION

This invention relates in general to the field of drilling wells, and more particularly to an improved system and method for transporting, assembling and operating drilling equipment at oil and gas land-based well sites.

BACKGROUND OF THE INVENTION

Expanding world-wide energy demands have led the energy industry to an increasing exploration of remote oil and gas reserves. To meet the world's energy needs, the energy industry has explored remote and environmentally sensitive areas ranging from the mountainous jungle terrain in South America to the expansive frozen tundras of Canada, Alaska and Siberia. Although these remote locations hold promising oil and gas reserves, exploration, drilling and production from these remote locations presents significant challenges. As examples, the energy industry faces challenges in securing economic production of energy reserves, in maintaining a safe environment for workers operating drilling rigs, and in protecting the environment of the remote areas from contamination and extensive drill-site development-related damages.

One primary economic concern related to remote land-based reserve development is the expense of transporting and setting up drilling equipment at the remote sites. Conventional drilling equipment for drilling oil and gas wells is heavy and bulky, making transportation of the equipment difficult. Many remote sites lack developed road systems for transporting heavy equipment, increasing the amount of time that the drilling equipment needs for transportation between drilling sites. In some instances, such as in remote jungle locations, it is impractical to build roads to transport equipment, making development of the remote reserves uneconomical with conventional drilling equipment.

Logistic issues associated with transporting drilling equipment not only increases the cost of transportation, but increases the capital cost of an energy exploration and development project. For instance, conventional drilling equipment is an expensive capital investment that remains unused during transportation. Further, the workers that operate the drilling equipment are generally unproductive during transportation times. Thus, extended periods of time used to transport drilling equipment can drastically increase the overhead associated with a given well operation. This translates into thousands of dollars for an energy company that is attempting to develop remote energy reserves.

Another difficulty associated with remote energy reserve development is the potential for environmental damage to the remote drilling site. For instance, conventional land-based drilling equipment tends to use an extensive footprint to drill a well. A relatively large surface area is used to assemble and disassemble the drilling equipment and to operate the drilling rig. The larger the footprint, the greater the potential environmental impact that the drilling site will have on the surrounding environment. Further, in mountainous terrain, large footprint drilling sites are difficult to construct and manage, particularly when large earth moving and clearing machines are used to prepare the drilling site.

In addition to the environmental impact of establishing the drilling site, other environmental impacts result from actual drilling operations. These impacts can vary from the noise generated by the drilling operation to the chemicals, mud and fuel used to support the drilling operation and the byproducts of the drilling operation. For instance, drilling operations require a supply of fuel, chemicals and mud to drill the well. Further, the drilling operation creates byproducts that can contaminate the surface environment. Controlling and storing the materials used by and created by the drilling operation presents considerable logistical difficulties to the drill operator.

Another important consideration to drilling operations is the safety of the personnel performing the operations. Drilling is inherently dangerous, and this danger is increased by transportation of the drilling equipment over significant distances. Safety considerations can shut down drilling operations if, for instance, essential drilling equipment becomes impaired or inoperable, or is just plain missing. When the drilling equipment is transported over extensive distances, essential equipment can easily be forgotten or misplaced. Further, safety is of extreme importance at remote sites which are located large distances from medical assistance.

SUMMARY OF THE INVENTION

Therefore, a need has arisen for a modular mobile well drilling system and method which reduces the expense of establishing a well site, including assembling and operating the rig.

A further need exists for a drilling system and method which is easy to assemble and disassemble for transportation between remote land-based drilling sites.

A further need exists for a drilling system and method which reduces the time of transportation between remote drilling sites.

A further need exists for a drilling system and method which supports multi-well development pads with helicopter transportation of the drilling system to remote, land-based drilling sites.

A further need exists for a drilling system and method which transports in modules convenient to maintain system integrity and which disassembles into lightweight packages for helicopter transportation.

A further need exists for a drilling system and method which reduces the environmental impact of drilling on a remote drilling site.

A further need exists for a drilling system and method which reduces the footprint of the drilling site to reduce environmental impact.

A further need exists for a drilling system and method which provides increased safety for drilling operations.

In accordance with the present invention, a drilling system and method is provided that substantially eliminates or reduces disadvantages and problems associated with previously developed drilling systems and methods.

The system provides modular support boxes to support a drilling platform. The drilling platform rests on some but not all of the support boxes. An actuator, such as a jacking system, integrated with the drilling platform moves the drilling platform relative to the boxes to allow alignment of drilling equipment with predetermined positions in a drilling zone located below the platform. Transportation of the drilling equipment from the drilling site to a remote drilling site is accomplished by transporting boxes that do not support the drilling platform to the remote site, transporting the drilling platform to rest on the transported boxes at the remote site, and then transporting the remaining support boxes to the remote drilling site.

More specifically, a plurality of support boxes are fixedly deployed in first and second rows so that the area between the rows defines a drilling zone. Platform support beams are disposed from the first row to the second row to support a platform coupled to the beams. An actuator associated with the platform and beams moves the support beams relative to the boxes to align the platform with predetermined positions in the drilling zone.

The support of the drilling platform and support beams by some but not all of the support boxes provides enhanced transportability of the drilling system from one site to another site. The support boxes not supporting the drilling platform are disassembled and transported to another drilling site. Once located at the second drilling site, the support boxes provide a base to support the drilling platform at the new site. The drilling platform is disassembled at the first drilling site, transported to the second drilling site, and assembled on the boxes located at the second drilling site. The boxes remaining at the first drilling site are then transported to the second drilling site to provide a support base for moving the drilling platform over the drilling zone of the second site.

The modular construction of the boxes, the platform, and associated drilling equipment simplify preparation for transportation to different sites, and optimize the weight and bulk of each transportation load to minimize the total number of loads. For instance, the drilling platform can support a vertically assembled mast, such as a boot-strap mast, that breaks down into sections for vertical assembly on the platform. Each section of the mast is suitable for helicopter transportation based on bulk and weight constraints. Similarly, each support box is suitable to helicopter transportation to remote locations based on bulk and weight constraints. The modular design simplifies assembly and disassembly, thus requiring reduced footprint at the drilling site and having a lower bearing load to provide increased utility on unstable soil conditions. Related drilling equipment also packages in modules to enable helicopter transportation.

The present invention provides many advantages. One important advantage is a substantial reduction in the expense of remote drilling operations. For instance, the modular assembly and disassembly of the drilling equipment provides a simplified and less time-consuming assembly and disassembly process. By reducing transportation, assembly and disassembly time periods, the present invention reduces the overhead expense associated with establishing remote drilling operations.

Another important technical advantage of the present invention is a reduced environmental impact at a drilling site. For instance, the modular and integrated approach for assembly and disassembly of the drilling equipment reduces the footprint needed at the remote site by allowing assembly and disassembly concurrent with transportation. The reduced footprint not only reduces the environmental damage to a site, but also reduces the expense associated with site preparation and cleanup. Further, the modular assembly and disassembly simplifies drilling operations, reducing the likelihood of accidents such as spilling of toxic chemicals, fuel and mud.

Another important technical advantage of the present invention is the increased safety available to workers at the drilling site. The modular assembly and disassembly of the drilling equipment helps organize and track essential equipment to avoid oversights. Further, the simplified assembly and disassembly reduces the amount of labor needed to set up drilling operations at remote locations, thus lowering the potential for accidents.

BRIEF DESCRIPTION OF THE DRAWINGS

A more complete understanding of the present invention and advantages thereof may be acquired by referring to the following description taken in conjunction with the accompanying drawings in which like reference numbers indicate like features and wherein.

DETAILED DESCRIPTION OF THE INVENTION

Preferred embodiments of the present invention are illustrated in the figures, like numerals being used to refer to like and corresponding parts of the various drawings.

Oil exploration and drilling operations at remote locations present unique challenges that are beyond the capability of conventional land-based drilling equipment. Conventional land-based drilling equipment is generally bulky and heavy, and is usually transported to drilling sites by truck or other heavy equipment. The present invention uses a modular approach to support integrated assembly and disassembly of drilling equipment in an incremental fashion. By limiting module bulk and weight, helicopter transport is made possible. Thus, the modules described herein are generally limited to a weight of ten metric tons, which can be transported by a Chinook-type of helicopter.

Figure 1:
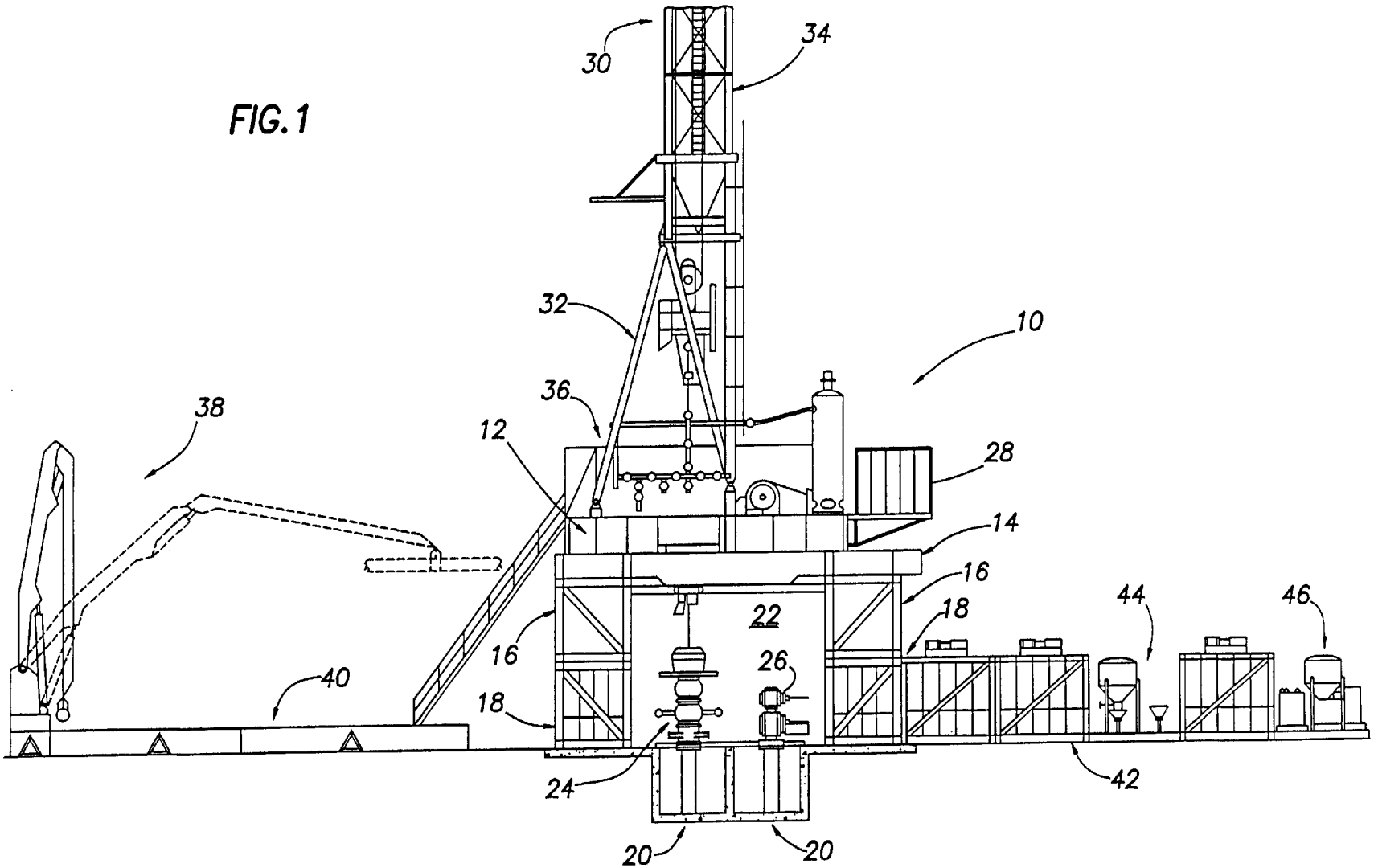
FIG. 1 depicts a side cutaway view of a drilling site assembled with mobile modules.

Referring now to FIG. 1, a side cutaway view of a drilling system is depicted, based on assembly of modules according to the present invention. A drilling rig 10 rests on a drilling platform 12. Drilling platform 12 is supported on strong back beam 14, which spans over two spaced rows of working deck support boxes 16 resting on top of storage support boxes 18. Typically, plural parallel beams 12 span the rows of support boxes to provide a stable support for drilling platform 12 and to allow space below drilling platform 12 for the suspension of drilling equipment. Strong back beams 14 slide longitudinally on support boxes 16 and drilling platform 12 slides laterally on strong back beams 14 to allow drilling of wells 20 side-by-side laterally and longitudinally spaced 10 feet apart within a drilling zone 22.

FIG. 1 depicts a well control blow-up prevention (BOP) system 24 arranged above one well 20 to support drilling operations. A well head 26 caps a completed well next to well having the BOP system. BOP system 24 is a 16¾ inch 5000 psi stack consisting of an annular and two single ram preventors. This BOP arrangement allows skidding over the well heads should a need arise to skid over a completed well.

Working deck support boxes 16 are coupled to storage support boxes 18, which are in turn coupled to the ground to provide a secure base that can support skidding of beams 14 along the length of the boxes and that can support lateral skidding of drilling platform 12. Working deck support boxes 16 enclose a working area for personnel who are operating the drilling equipment. Storage support boxes 18 provide storage for mud, fuel, water, and additional supplies. Working deck support boxes 16 and storage support boxes 18 establish a "box-on-box" substructure that integrates rig components. The substructure formed by working deck support boxes 16 and storage support boxes 18 define a drilling zone 22, having adequate space between the substructure to support multi-well clusters of two or more wells laterally displaced across the width of drilling zone 22. The ability to drill "multi-well" side-by-side well rows, as is explained in greater detail below, reduces rig location requirements, resulting in a reduced total site footprint for a given number of wells.

The box-on-box substructure formed by working deck support boxes 16 and storage support boxes 18 establishes a firm base for supporting strong back beams 14. Series of stacked boxes form parallel rows that define the length of drilling zone 22. Strong back beams 14 allow drilling platform 12 to skid across the length of the boxes, thus realigning drilling rig 10 in drilling zone 22 to support drilling of multiple wells along the drilling zone length. Drilling platform 12 rests on strong back beams 14 and skids laterally from one side of the substructure to the other side, enabling lateral spacing of wells along the width of drilling zone 22.

Drilling rig 10 includes draw works 28, a top drive and a boot strap mast 30 and for drilling wells. Draw works 28 is a Continental Emsco Electro-hoist IID 2000 HP draw works equipped with a main disc brake and a water cooled Baylor retarder brake to reduce noise produced by drilling operations. The Electrohoist includes a gear driven transmission to reduce weight compared with chain driven drives.

Boot strap mast 30 is a vertically assembled mast formed with modular components similar to offshore M.A.S.E. type rigs constructed by Nabors Offshore Limited, but splits into relatively small components for helicopter transportation. Mast 30 is rated for a one million pound static hook load and includes a crown assembly capable of 12 lines. An A-leg assembly 32 couples to drilling platform 12 to form the base of boot strap mast 30. The crown assembly is placed on A-leg assembly 32 and raised to allow insertion of mast modules between A-leg 32 and the crown. Mast modules 34 are assembled on top of A-leg 32 until an adequate mast height is achieved. The vertically assembled mast reduces the footprint of the drilling site by eliminating the need of raising a horizontally assembled mast into a vertical position. Further, the modular construction of the vertically assembled mast enhances transportation to and from remote sites.

A pipe setback area 36 rests at the base of A-leg 32 to allow convenient access of pipes needed for drilling operations. In one embodiment, a pipe handler 38 is assembled next to drilling rig 10 to ease loading of pipes to pipe set back area 36. Pipe handler 38 is a pedestal mounted crane capable of moving 2500 Kg at a radius of 21 meters. A catwalk 40 is supplied for ease of access for transferring pipe supplies to the drilling rig 10. On the opposite side of drilling rig 10, a mud process area provides convenient access of mud to the drilling rig and well. Mud modules 42, chemical mix equipment 44, and cement mix equipment 46 are provided in uniform size modules to allow ease of transport and convenience of use.

Figure 2:
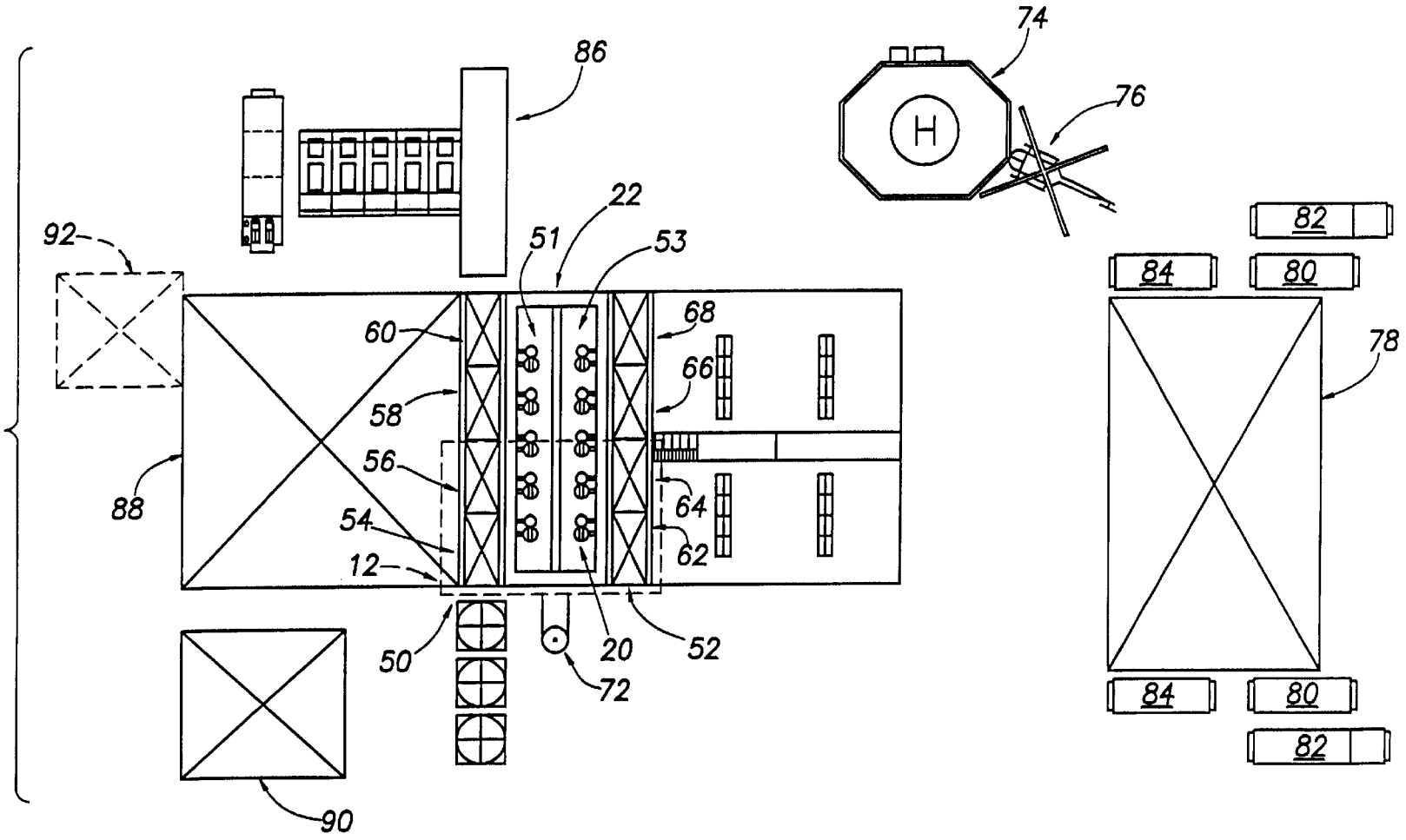
FIG. 2 depicts a top location view of a drilling site assembled with mobile modules.

Referring now to FIG. 2, a top view of a drilling site layout is depicted. A first row of support boxes 50 and a second row of support boxes 52 are arranged in a parallel fashion to define the length of drilling zone 22. A dashed line depicts the general position of drilling platform 12, supported on boxes 54, 56, 62, and 64.

An actuator 72 associated with drilling platform 12 skids the drilling platform 12 along a vector parallel to first support box row 50 and second support box row 52 so that drilling platform 12 incrementally aligns with predetermined well positions. For instance, actuator 72 moves drilling platform 12 from the depicted position to a position aligned with support boxes 58, 56, 66, and 64. After wells are drilled in the area of drilling zone 22 defined by these support boxes, actuator 72 moves drilling platform 12 to align with support boxes 58, 60, 66 and 68. Drill platform 12 supports drilling of a first row 51 of wells 20 proximate to the first row of support boxes 50 and a second row 53 of wells 20 proximate to the second row of support boxes 52. The drilling of first and second rows of wells 20 is accomplished by moving drilling rig 10 laterally across drilling zone 22 from a position aligned with first row 51 to a position aligned with second row 53.

As depicted by FIG. 2, ten wells can be drilled in two rows of five wells each. In alternative embodiments, greater spacing between the first row of support boxes 50 and second row of support boxes 52 can enable the drilling of additional well rows. Alternatively, additional support boxes can be added to lengthen first support box row 50 and second support box row 52 to increase the length of drilling zone 22, thus allowing additional wells to be drilled along the length by moving beams 12 over the additional support boxes.

The moving of drilling platform 12 across support box rows 50 and 52 advantageously enhances transportation of the drilling equipment to a second site. With drilling platform 12 supported by support boxes 54, 56, 62 and 64, the remaining support boxes 58, 60, 66 and 68 can be moved to a new drilling site. Once relocated, these support boxes will allow an immediate setup of drilling rig 10 and drilling platform 12 at the new site on the relocated boxes. After drilling rig 10 and drilling platform 12 are relocated to the new site, the remaining support boxes 54, 56, 62 and 64 can be relocated to the new site to enable drilling of multiple wells along the length of the substructure at the new site.

The location layout depicted by FIG. 2 exemplifies the minimal footprint used at a site set up with the modular components of the present invention. A helicopter pad 74 and helicopter 76, such as a Boeing 234 Chinook, enable transportation of the equipment located at the site to other remote sites. To enhance transportation by helicopter, the modules used for transportation, including the support boxes, are designed to have a weight of approximately ten metric tons.

A 100-man stackable camp 78 provides support for drill operating personnel. The camp includes two generator sets 80 so that one generator provides power at the existing site during disassembly and transportation of the drill equipment to the new site, and the second generator set provides power at the new drill site during assembly of the drill equipment at the new site. Similarly, redundant water storage 82 and redundant waste treatment 84 simultaneously support an existing and new site by staggered transportation so that identical support equipment is available for periods during rig moves when personnel may be required at both the new location and the existing location. Living facilities are constructed from lightweight materials, such as aluminum and "divinycel" materials that are durable and lightweight for transportation.

A power and control assembly 86 supports drilling power and control needs. An IDM Controls SCR system has a five SCR bay system that drives and controls three 1,600 horsepower mud pumps and a 2,000 horsepower draw works and top drive system. The SCR has a modular design to split SCRs between drill floor requirements and mud module equipment. Power and control assembly 86 can include automatic drilling systems to monitor drilling parameters.

A mud processing and pumping area 88 supports drilling requirements for drilling mud. A mud storage and mix area 90 provides 2,000 cubic foot bulk storage for barite and 2,000 cubic foot bulk storage for cement, with chemical additives supplied in big bag form, liquid drums and/or tote tanks to allow modular transportation. The barite and cement are transported to mud processing area 88 and dispensed in bulk mix silos mounted above a mix hopper for direct transfer to the recirculating cement mixer or mud mix system. This system minimizes a need for operator involvement and provides dust free operation for environmental considerations.

An injection slurrification unit 92 supports zero discharge disposal of mud drill cuttings in response to environmental and regulatory concerns. Injection slurrification unit 92 can support thermal processing to clean or dispose of pollutants from cuttings and reinjection of cuttings as an environmentally safe means of disposal.

Figure 3:
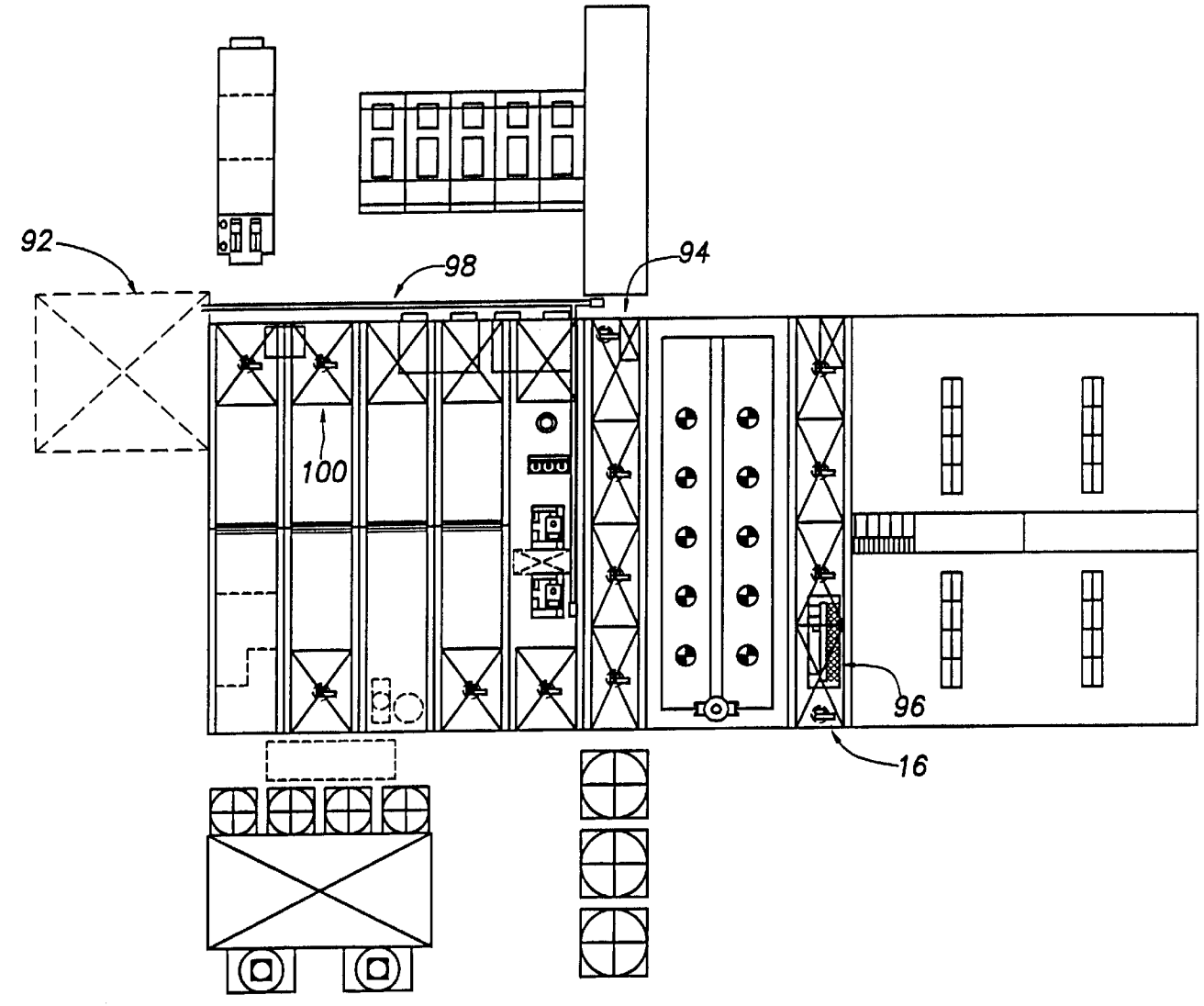
FIG. 3 depicts a top view of the process level of modules assembled at a drilling site.

Referring now to FIG. 3, the process level of the drilling site is depicted. Working deck boxes 16 provide an operating area for personnel and operating equipment. For instance, a trip tank compartment 94 is incorporated in a support box 16 with desilting and desanding equipment. The integration of operating equipment simplifies modular transport of support boxes and associated equipment. An auger 98 or other material handling equipment allows automatic transfer of waste material to injection slurification equipment 92. Reclaim equipment 100 supports processing of waste products in with a modular arrangement.

Figure 4:
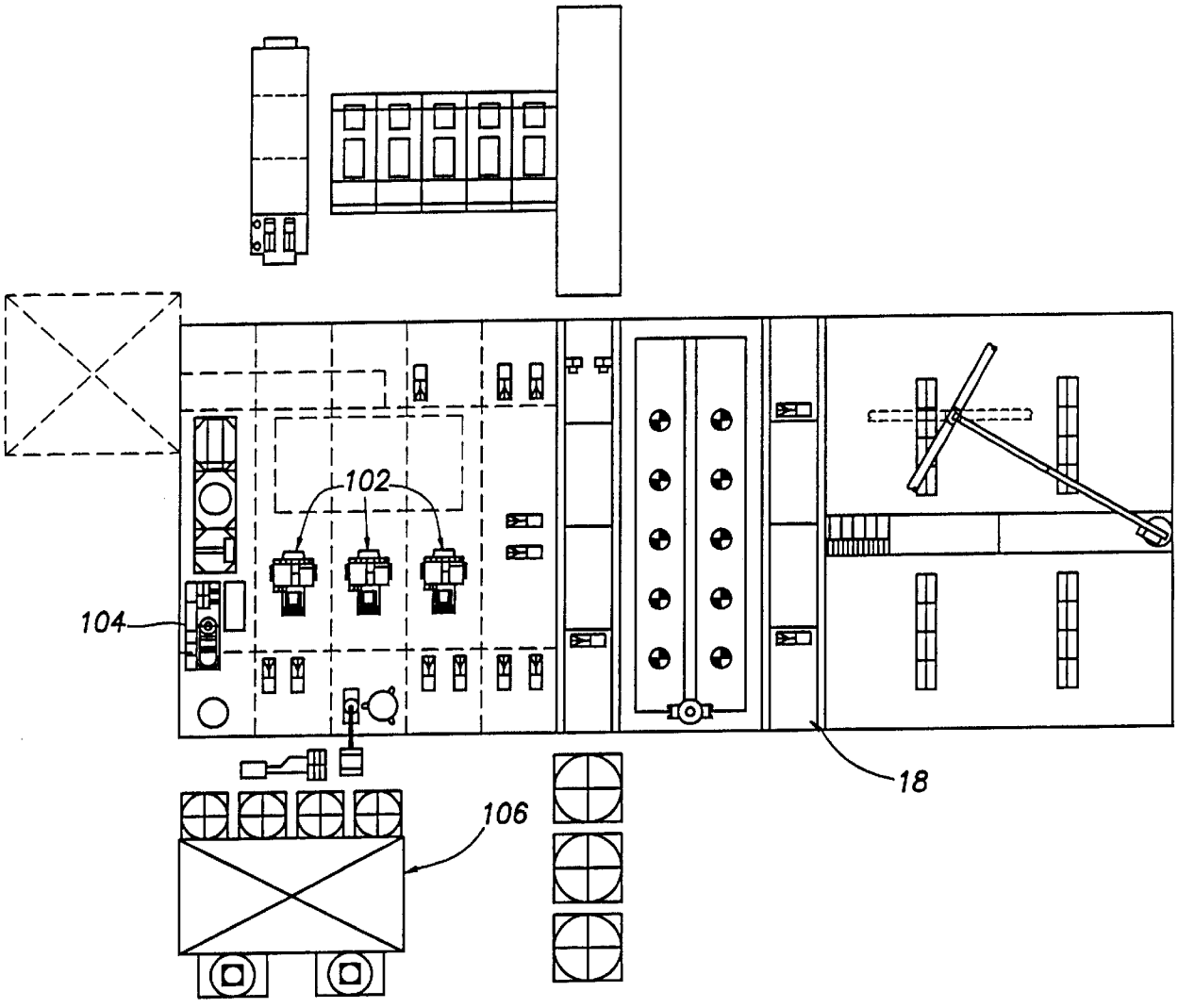
FIG. 4 depicts a top view of the ground level modules assembled at a drilling site.
Figure 4A:
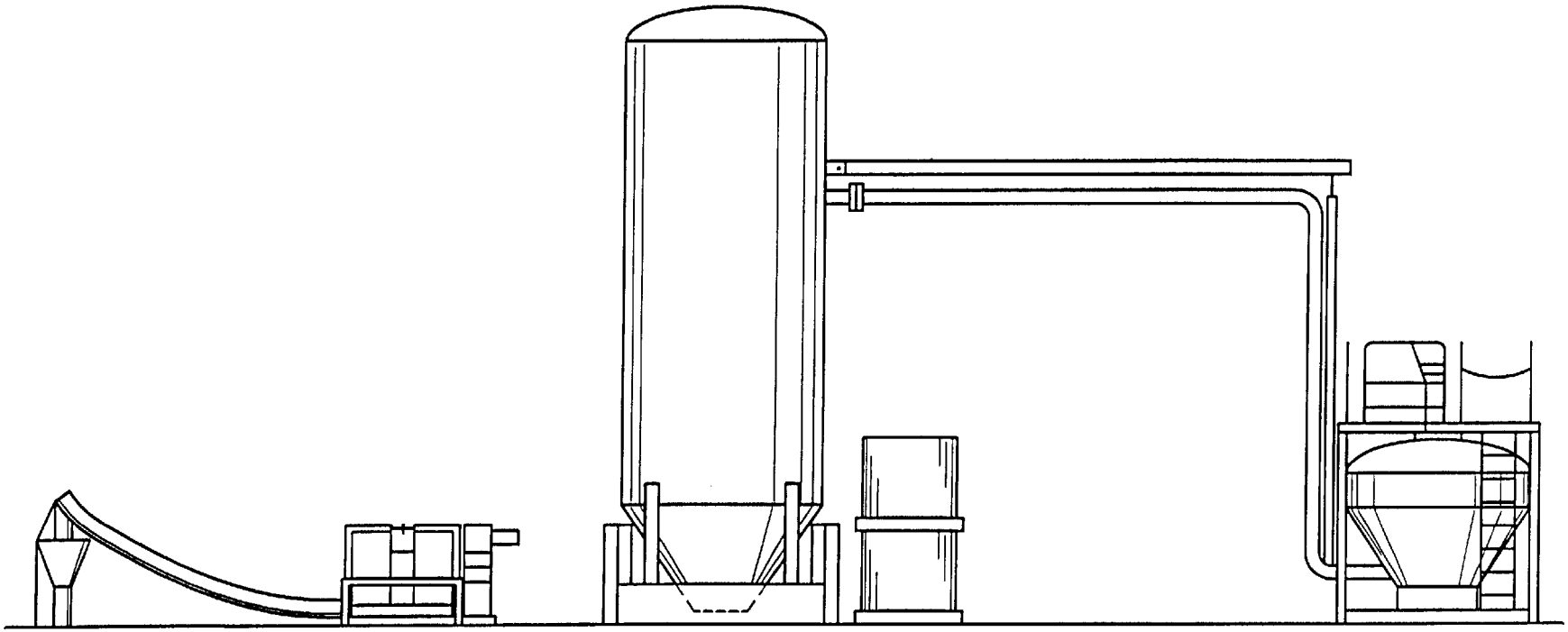

Referring now to FIG. 4, the ground level of the drilling site is depicted. Storage boxes 18 provide storage of mud and fuel. Mud pumps 102 and cement mixing equipment 104 are located in modular sections to enhance rapid disassembly, transport and reassembly. A chemical storage unit, depicted in greater detail by FIG. 4A, stores mud and related drilling chemicals for use by the mud processing equipment.

Figure 5:
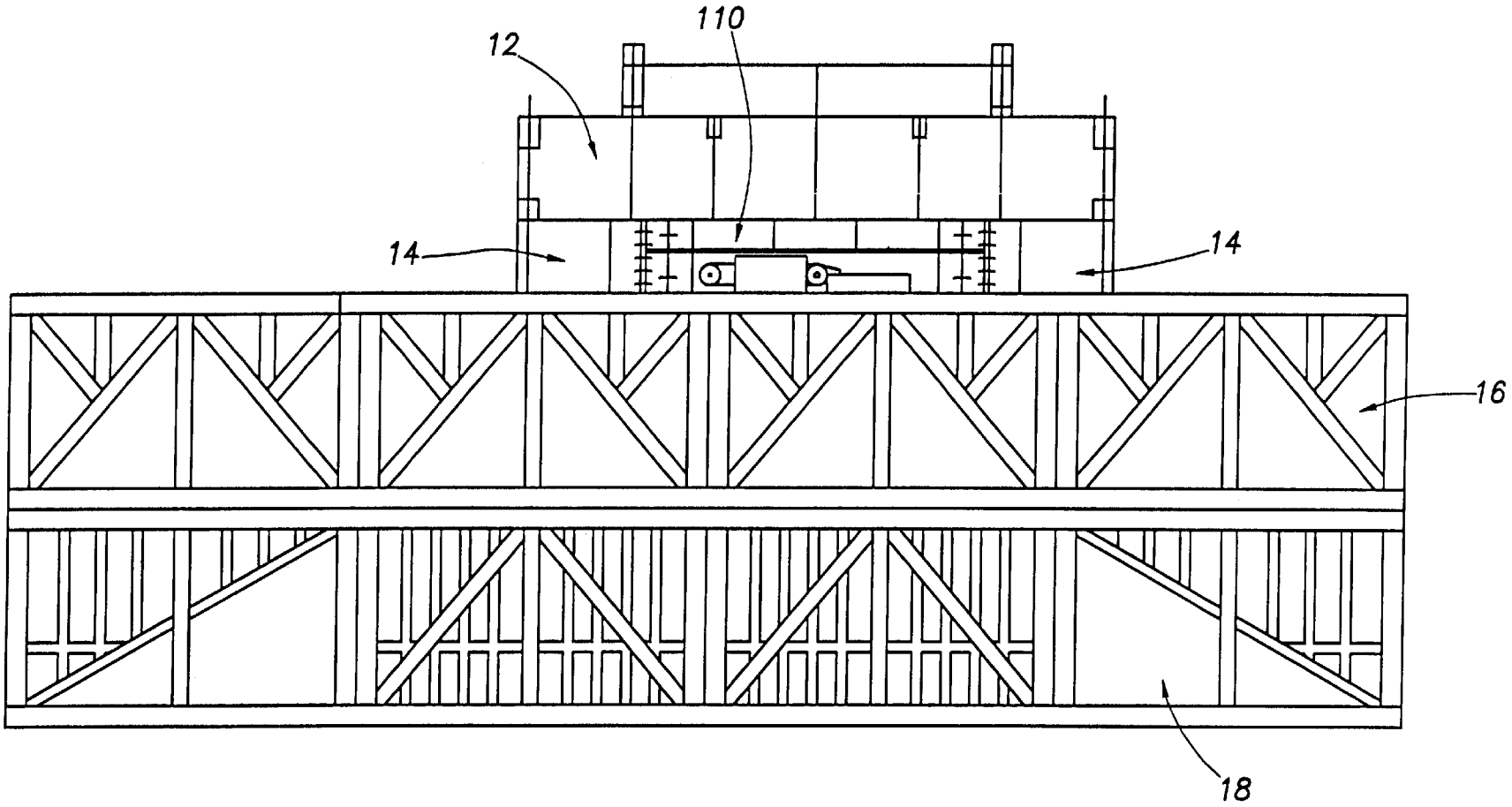
FIG. 5 depicts a side view of a jacking system for enabling platform movement.

Referring now to FIG. 5, a side view of an assembled system according to the present invention is depicted. Support boxes 16 rest on support boxes 18 to form a box-on-box substructure for supporting the drilling rig above the drilling zone. Strong back beams 14 rest in a sliding relationship on support boxes 16 to allow longitudinal movement of beams 14 along the box-on-box substructure. Drilling platform 12 is constructed in a similar sliding relationship on beams 14 so that a drilling rig assembled on platform 12 will move laterally to predetermined positions in the drilling zone in accordance with the movement of beams 14. An actuator 110, such as a hydraulic jacking system available from IRI International Corporation, cooperates with support boxes 16 and beams 14 to provide the desired movement of platform 12. Actuator 110 supports lateral and longitudinal movement needed for drilling multi-well developments pads, such as the five-by-two well arrangement depicted in FIGS. 2 and 3. In alternative embodiments, different multi-well arrangements can be supported.

Although the present invention has been described in detail, it should be understood that various changes, substitutions and alterations can be made hereto without departing from the spirit and scope of the invention as defined by the appended claims.

What is claimed is:

1. A system for land-based drilling operations, the system comprising:

a plurality of support boxes fixedly deployed in a first row and a plurality of support boxes fixedly deployed in a second row, said rows defining a drilling zone a plurality of platform support beams disposed from the first row to the second row;

a platform coupled to the plurality of support beams, the platform for supporting drilling equipment; and an actuator associated with the platform and beams, the actuator for moving the support beams relative to the boxes to align the platform with predetermined positions in the drilling zone.

2. The system according to claim 1 further comprising a vertically-assembled mast coupled to the platform.

3. The system according to claim 2 wherein the vertically-assembled mast comprises a boot strap mast.

4. The system according to claim 2 wherein the support boxes, support beams, platform and mast comprise modular components suitable for helicopter transportation.

5. A method for land-based drilling operations, the method comprising the steps of:

providing a plurality of boxes at a first drilling site;

providing a drilling platform at said first drilling site and supporting said platform on some but not all of said plurality of boxes;

transporting the boxes not supporting the drilling platform to a second drilling site;

disassembling the drilling platform at the first drilling site;

transporting the drilling platform to the second drilling site;

assembling the drilling platform on the boxes at the second drilling site; and transporting the boxes remaining at the first drilling site to the second drilling site.

6. The method according to claim 5 wherein said transporting the boxes step further comprises transporting the boxes by helicopter.

7. The method according to claim 5 wherein said assembling the drilling platform step further comprises:

arranging the boxes in first and second rows, the rows defining a drilling zone; and supporting the drilling platform on the boxes above the drilling zone.

8. The method according to claim 7 wherein said transporting the boxes remaining at the first site step further comprises the steps of:

arranging the remaining boxes along the first and second rows to extend the drilling zone; and moving the drilling platform relative to the boxes to align the platform with predetermined positions in the drilling zone.

9. The method according to claim 5 wherein said assembling the drilling platform step further comprises vertically assembling a mast on the drilling platform.

10. The method according to claim 9 wherein the mast comprises a boot-strap mast.

* * * * *